US007012415B2

(12) United States Patent
Moraveji

(10) Patent No.: US 7,012,415 B2
(45) Date of Patent: Mar. 14, 2006

(54) WIDE SWING, LOW POWER CURRENT MIRROR WITH HIGH OUTPUT IMPEDANCE

(75) Inventor: Farhood Moraveji, Saratoga, CA (US)

(73) Assignee: Micrel, Incorporated, San Jose, CA (US)

( * ) Notice: Subject to any disclaimer, the term of this patent is extended or adjusted under 35 U.S.C. 154(b) by 148 days.

(21) Appl. No.: 10/688,050

(22) Filed: Oct. 16, 2003

(65) Prior Publication Data

US 2005/0083029 A1 Apr. 21, 2005

(51) Int. Cl.
*G05F 3/16* (2006.01)

(52) U.S. Cl. ..... 323/315

(58) Field of Classification Search ..... 323/312, 323/313, 315, 316; 327/530, 538
See application file for complete search history.

(56) References Cited

U.S. PATENT DOCUMENTS 4,663,584 A * 5/1987 Okada et al. ..... 323/313
5,680,038 A * 10/1997 Fiedler ..... 323/315
5,869,997 A * 2/1999 Tomishima ..... 327/543
6,118,266 A * 9/2000 Manohar et al. ..... 323/316
6,737,849 B1 * 5/2004 Eshraghi et al. ..... 323/315
6,759,888 B1 * 7/2004 Wodnicki ..... 327/382

* cited by examiner

*Primary Examiner*—Adolf Berhane
(74) *Attorney, Agent, or Firm*—Bever, Hoffman & Harms, LLP; Patrick T. Bever

(57) ABSTRACT

A current mirror includes a serially connected diode-connected transistor of a first conductivity type, a saturated (fully-on) transistor of a second conductivity type, and a current source for providing a reference current. A gate voltage generated by the diode-connected transistor in response to the reference current is provided to the gate of a matching transistor. This causes the matching transistor to mirror the reference current. Meanwhile, an output transistor cascoded with the matching transistor is gate-coupled to the junction between the saturated transistor and the current source. This allows the output transistor to provide an output voltage swing from one supply voltage to two saturation voltage drops from the second supply voltage. Meanwhile, the cascode configuration gives the current mirror a high output impedance.

17 Claims, 5 Drawing Sheets

WIDE SWING, LOW POWER CURRENT MIRROR WITH HIGH OUTPUT IMPEDANCE

BACKGROUND OF THE INVENTION

1. Field of the Invention

The invention relates to electronic circuits, and in particular to a power-efficient current mirror with high output impedance and a wide output voltage range.

2. Related Art

A current mirror is used to duplicate a reference current in an integrated circuit (IC) for use in a different portion(s) of the IC. By providing this duplicate current, the current mirror can minimize the effects of the circuit operation on the reference current source.

FIG. 1 shows a conventional current mirror 100 that includes a reference current source CS11, an output terminal 101, a reference transistor M11, and an output transistor M12. Current source CS11 and transistor M11 are connected in series between a supply voltage VDD and ground, while transistor M12 is connected between output terminal 101 and ground. The gates of transistors M11 and M12 are connected, and the gate of transistor M11 is connected to its drain (i.e., transistor M11 is diode-connected).

To provide proper current mirroring, transistors M11 and M12 must be operating in saturation to ensure that voltage changes at output terminal 101 do not affect the value of output current I_OUT. As is known in the art, a transistor operates in its saturated region when its drain-source voltage Vds is at least as great as its gate (gate-source) voltage Vgs minus its threshold voltage Vt (i.e., the voltage at which the inversion layer is formed). The minimum value of the source-drain voltage Vds that satisfies this relationship is termed the saturation (or overdrive) voltage of the transistor, and can be expressed as follows:

$$Vdsat=Vgs-Vt \tag{1}$$

where Vdsat is the saturation voltage of the transistor.

Since transistor M11 is diode-connected, its drain-source voltage is guaranteed to be larger than its gate voltage, and so transistor M11 is in saturation. Therefore, when current source CS11 supplies a reference current I_REF to transistor M11, the voltage drop (Vds) across transistor M11 required to sink current I_REF is a saturation voltage Vdsat(11).

Then, using Equation 1, the gate voltage of transistor M11 can be determined as follows:

$$Vgs(\mathbf{11})=Vdsat(\mathbf{11})+Vt(\mathbf{11}) \tag{2}$$

where Vgs(11) is the gate-source voltage of transistor M11, and Vt(11) is the threshold voltage of transistor M11.

Because the gates of transistors M11 and M12 are connected, this gate-source voltage is also applied to transistor M12 (i.e., Vgs(12)=Vgs(11)). If transistors M11 and M12 are matched (i.e., the transistors have the same electrical characteristics, such as threshold voltage and saturation voltage), this gate-source voltage causes transistor M12 to sink a current I_OUT that is equal to reference current I_REF. In this manner, reference current I_REF can be mirrored to any circuit coupled to output terminal 101 of current mirror 100.

The minimum output voltage of current mirror 100 at output terminal 101 is equal to the minimum voltage drop across output transistor M12 before it falls out of saturation—i.e., saturation voltage Vdsat(12). Once transistor M12 is not operating in its saturated region, voltage changes at output terminal 101 can affect the current flow through transistor M12, thereby defeating the purpose of current mirror 100. Current mirror 100 beneficially provides a relatively large output voltage range (swing), since it allows proper current mirror operation to occur down to saturation voltage Vdsat(12).

However, because the output of current mirror 100 is at the drain of transistor M12, the output impedance of current mirror 100 is rather low. As is known in the art, the output impedance Rout(100) of current mirror 100 is given by the following:

$$Rout(\mathbf{100})=(\lambda(\mathbf{12})*I_OUT)^{-1} \tag{3}$$

where λ(12) is the channel length modulation parameter for transistor M12. Note that this output impedance is simply the output impedance Ro(12) of transistor M12.

To provide a current mirror that has an improved output impedance, negative feedback is sometimes used. For example, FIG. 2 shows a conventional Wilson current mirror 200 that includes a reference current source CS21, an output terminal 201, a reference transistor M21, a control transistor M22, and an output transistor M23. Current source CS21 and transistor M21 are connected in series between a supply voltage VDD and ground, while transistors M22 and M23 are connected in series between output terminal 201 and ground.

Note that, in Wilson current mirror 200, output transistor M23 is diode-connected, rather than reference transistor M21. This creates a negative feedback loop, between the source of control transistor M22 and the gate of reference transistor M21, that holds the output current I_OUT equal to reference current I_REF even if the output voltage (i.e., the voltage at output terminal 201) varies.

For example, an increase in the voltage at output terminal 201 increases the drain voltage of transistor M22, and will therefore attempt to increase the current flow through transistor M22, which in turn would try to force the gate voltage of transistor M23 to increase. This increased gate voltage would also be provided to transistor M21. However, since reference current I_REF is constant, the drain voltage of transistor M21 must then decrease. As a result, the gate voltage of transistor M22 is decreases, thereby maintaining output current I_OUT at a level equal to reference current I_REF.

As is known in the art, the output impedance Rout(22) of Wilson current mirror 200 is given by the following:

$$Rout(\mathbf{200})\approx Ro(\mathbf{22})(2+_gm(\mathbf{21})Ro\mathbf{21})) \tag{4}$$

where Ro(22) is the output impedance of transistor 22, gm(21) is the transconductance of transistor M21, and Ro(21) is the output impedance of transistor M21. Thus, the negative feedback loop of Wilson current mirror 200 results in an output impedance that is much greater than the output impedance of transistor M22 by itself.

However, this increased output impedance comes at the cost of reduced output voltage swing (range). As mentioned above, the output voltage of current mirror 100 shown in FIG. 1 can go all the way down to the minimum voltage drop across output transistor M12—i.e., saturation voltage Vdsat (12). By contrast, the minimum output voltage of Wilson current mirror 200 is much higher, resulting in a lesser net output voltage range.

In particular, using Equation (2) above, the gate voltage of transistor M23 is given by:

$$Vgs(\mathbf{23})=Vdsat(\mathbf{23})+Vt(\mathbf{23}) \tag{5}$$

where Vgs(23), Vdsat(23), and Vt(23) are the gate, saturation, and threshold voltages, respectively, of transistor M23. Since transistor M23 is diode-connected, this is also the drain voltage of transistor M23, and the source voltage of transistor M22.

Thus, the minimum output voltage Vo(min) of Wilson current mirror 200 is equal to this gate voltage plus the voltage drop across transistor M23, as shown by the following:

$$Vo(\min)=Vdsat(23)+Vt(23)+Vdsat(22) \quad (6)$$

where Vdsat(22) is the saturation voltage of transistor M22. Transistors M21, M22, and M23 will typically be matched, so that the minimum output voltage Vo(min) for Wilson current mirror 200 given in Equation 6 resolves to:

$$Vo(\min)=Vt+2Vdsat \quad (7)$$

where Vdsat and Vt are the saturation voltage and threshold voltage, respectively, of both transistors M22 and M23 (and transistor M21). Thus, the improved output impedance of Wilson current mirror 200 comes at the expense of reduced output voltage swing, in comparison to current mirror 100.

To provide improved output voltage range while maintaining high output impedance, some current mirror circuits combine a cascoded output with multiple control branches. For instance, FIG. 3 shows a conventional wide-swing cascode current mirror 300 that includes current sources CS31 and CS32 (both providing a reference current Io1), an output terminal 301, and transistors M31, M32, M33, M34, M35, and M36. Current source CS31, transistor M31, and transistor M32 are connected in series between supply voltage VDD and ground to form a first control branch. Current source CS32, transistor M33, and transistor M34 are connected in series between supply voltage VDD and ground to form a second control branch. Transistors M35 and M36 are connected in series between output terminal 301 and ground to form a cascode output branch.

The current mirroring operation of cascode current mirror 300 begins with transistor M33, which is coupled to receive reference current Io1 from current source CS32. Because it is diode-connected, transistor M33 is in saturation and sinks reference current Io1. Transistor M34, which is gate-coupled to the gate of transistor M33, is sized to also sink reference current Io1, but operate in the linear region, as described in greater detail below.

Meanwhile, the gate of transistor M33 is also connected to the gates of transistors M31 and M35. Transistors M31 and M35 are matched to transistor M33, and therefore sink the same current Io1 (from current source CS31 and as output current I_OUT, respectively) in response to the gate voltage from transistor M33.

Finally, transistor M32 is gate-coupled to the drain of transistor M31 and the gate of transistor M36. Since transistor M31 is operating in saturation, transistor M32 is essentially diode-connected, and also operates in saturation to sink current Io1 from transistor M31. Transistor M36 receives the same gate voltage from transistor M36, and so also operates in saturation to sink the output current I_OUT (equal to reference current Io1) from transistor M35. In this manner, cascode current mirror 300 provides proper current mirroring functionality.

The minimum output voltage of cascode current mirror 300 is determined by the gate voltages provided to cascoded transistors M35 and M36. As noted above, the voltage provided to the gate of transistor M35 is equal to the voltage at the gate of transistor M33. The voltage at the gate of transistor M33 is given by the following:

$$Vg(33)=Vgs(33)+Vds(34) \quad (8)$$

where Vgs(33) is the gate-source voltage of transistor M33 and Vds(34) is the drain-source voltage of transistor M34.

Transistor M34 is configured such that the when Vgs(33) is equal to Vdsat(33)+Vt(33), the voltage drop across transistor M34 is equal to Vdsat(33). As is known in the art, this is accomplished by sizing the W/L (width to length) aspect ratio of transistor M34 to be one-third of the W/L aspect ratio of transistor M33. Then, if transistors M31–M33 and M35–M36 are matched (i.e., have equal saturation voltages Vdsat and threshold voltages Vt), Equation 8 resolves to the following:

$$Vg(33)=Vt+2Vdsat \quad (9)$$

This voltage is provided to the gate of transistor M31, which is also operating in saturation. Therefore, the gate-source voltage Vgs(31) of transistor M31 is equal to its threshold voltage (Vt) plus its saturation voltage (Vdsat). The source voltage Vs(32) of transistor M32, which is equal to the actual voltage at the gate of transistor M31 minus the gate-source voltage of transistor M31, is therefore simply equal to saturation voltage Vdsat.

Because transistor M36 is gate-coupled to the gate of transistor M32, the source voltage of transistor M36 is also equal to Vdsat. Meanwhile, the drain-source voltage of transistor M35 can swing down to its saturation voltage Vdsat before it falls out of saturation. Therefore, the minimum output voltage of cascode current mirror 300 is twice saturation voltage Vdsat (i.e., 2Vdsat).

Thus, cascode current mirror 300 provides an improved output voltage swing over Wilson current mirror 200 (shown in FIG. 2) while maintaining a high output impedance. However, the added complexity of current mirror 300 (i.e., the additional control branch formed by current source CS32 and transistors M33 and M34) can have undesirable cost, die area, and power consumption consequences.

Accordingly, it is desirable to provide a simple current mirror circuit that provides a wide output voltage range with a high output impedance.

SUMMARY OF THE INVENTION

The invention includes a current mirror that provides high output impedance and high output voltage swing in a compact, simple design. The current mirror can be implemented using a single current source, thereby minimizing the power consumption of the current mirror.

According to an exemplary embodiment of the invention, a current mirror includes a current source, a saturated transistor of a first conductivity type, and a diode-connected transistor of a second conductivity type, all serially connected between first and second supply voltages.

The current mirror also includes an output transistor of the second conductivity type and a mirroring transistor of the second conductivity type that are serially connected between an output terminal and the second supply voltage. This cascoded pair of transistors ensures that the current mirror has a high output impedance.

The diode-connected transistor sinks (or sources) a reference current from the current source, and in the process generates a gate voltage that is supplied to the mirroring transistor. This gate voltage causes the mirroring transistor to sink (or source) an output current equal to the reference current.

Meanwhile, the gate of the output transistor is connected to the source of the saturated transistor, and therefore receives a gate voltage that is one saturation voltage higher than the gate voltage provided to the mirroring transistor. The output transistor is therefore able to sink (or source) the output current (reference current) generated by the mirroring transistor.

In addition, this gate voltage provided to the gate of the output transistor allows the current mirror to have a relatively wide output voltage range. Specifically, the drain of the output transistor can swing from the first supply voltage all the way to twice its saturation voltage from the second supply voltage (assuming that all transistors are matched) before the output transistor falls out of saturation.

The invention also includes methods of generating a current mirror output current. An exemplary method includes: providing a reference current to a diode-connected transistor via a saturated transistor, wherein the diode-connected transistor and the fully-on transistor have different conductivity types; providing the resulting gate voltage of the diode-connected transistor to a mirroring transistor to generate the output current; providing the output current to an output terminal via an output transistor; and providing the source voltage of the saturated transistor to the gate of the output transistor.

Another exemplary method includes: cascoding first and second transistors between an output terminal and a first supply voltage; supplying a reference current to a diode-connected third transistor via a fourth transistor (the third and fourth transistors having different conductivity types); providing the first supply voltage to the gate of the fourth transistor; providing the gate voltage of the third transistor to the gate of the second transistor; and providing the source voltage of the fourth transistor to the gate of the first transistor.

These and other aspects of the invention will be more fully understood in view of the following description of the exemplary embodiments and the drawings thereof.

DETAILED DESCRIPTION

Figure 4:
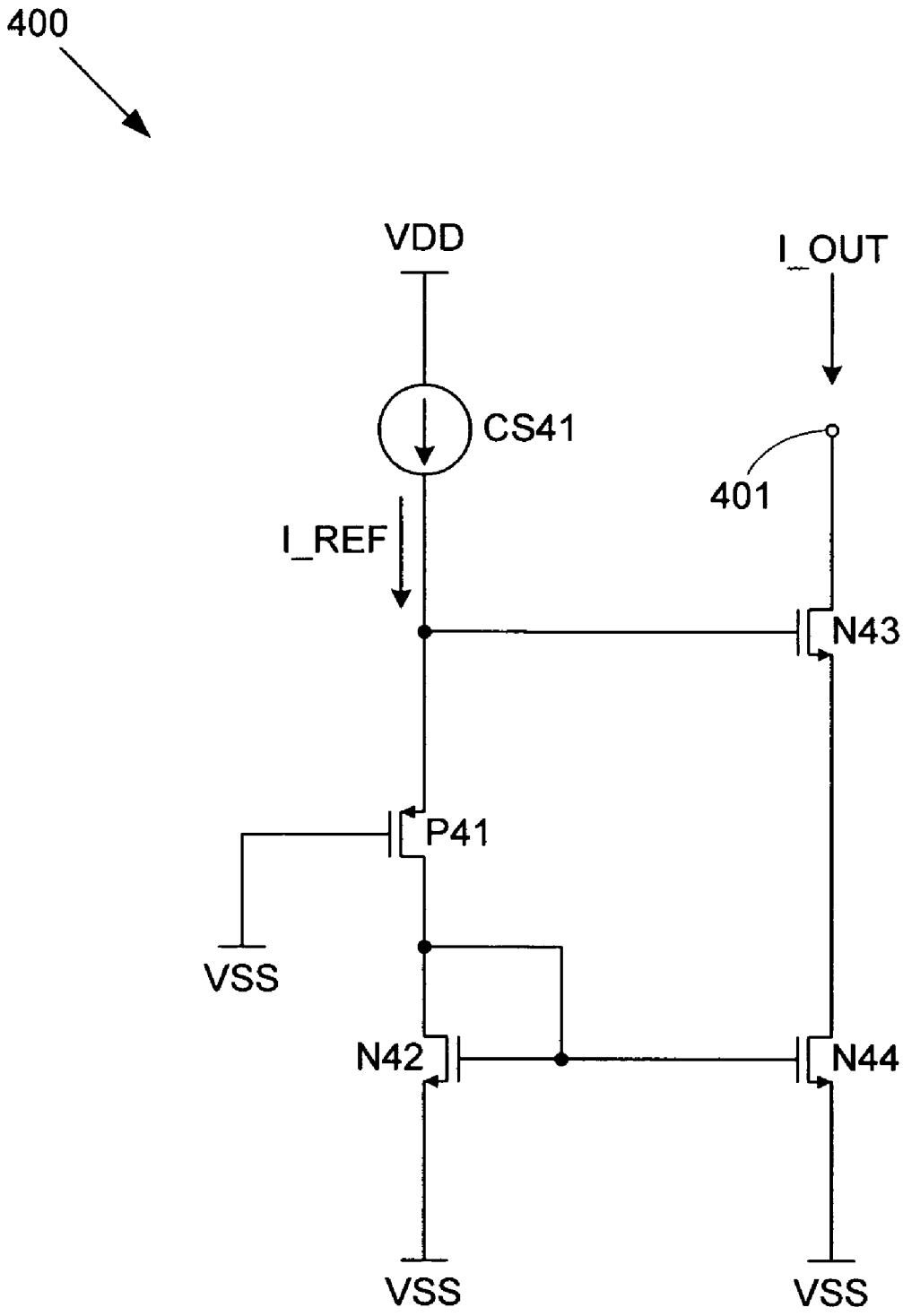
FIG. 4 is a circuit diagram of a high-swing current mirror with high output impedance, according to an embodiment of the invention.

FIG. 4 shows a current mirror 400 in accordance with an embodiment of the invention. Current mirror 400 includes a current source CS41, an output terminal 401, a PMOS (p-type metal-oxide-semiconductor) transistor P41, and NMOS (n-type metal-oxide-semiconductor) transistors N42, N43, and N44.

Note that, for exemplary purposes, transistors P41, N42, N43, and N44 are all described as being matched transistors, and therefore share the same saturation voltages Vdsat and threshold voltages Vt. This matching of transistors allows current mirror 400 to provide a gain of unity (i.e., output current I_OUT is equal to reference current I_REF). However, according to various other embodiments of the invention, the transistors can be sized differently (i.e., can have different gate widths and/or lengths) to produce differing electrical characteristics so that any desired gain can be provided by current mirror 400.

Current source CS41, transistor P41, and transistor N42 are connected in series between an upper supply voltage VDD and a lower supply voltage VSS (e.g., ground), while transistors N43 and N44 are connected in series between output terminal 401 and lower supply voltage VSS. Current source CS41 supplies (sources) a reference current I_REF that must flow to lower supply voltage VSS through transistors P41 and N42.

Because the gate of transistor N44 is connected to the gate of transistor N42, transistor N44 receives the same gate voltage generated by diode-connected transistor N42. Therefore, as long as the drain-source voltage across transistor N44 is large enough to keep transistor N44 in saturation (described in greater detail below), transistor N44 will mirror reference current I_REF as output current I_OUT (since transistors N42 and N44 are matched).

Figure 1:
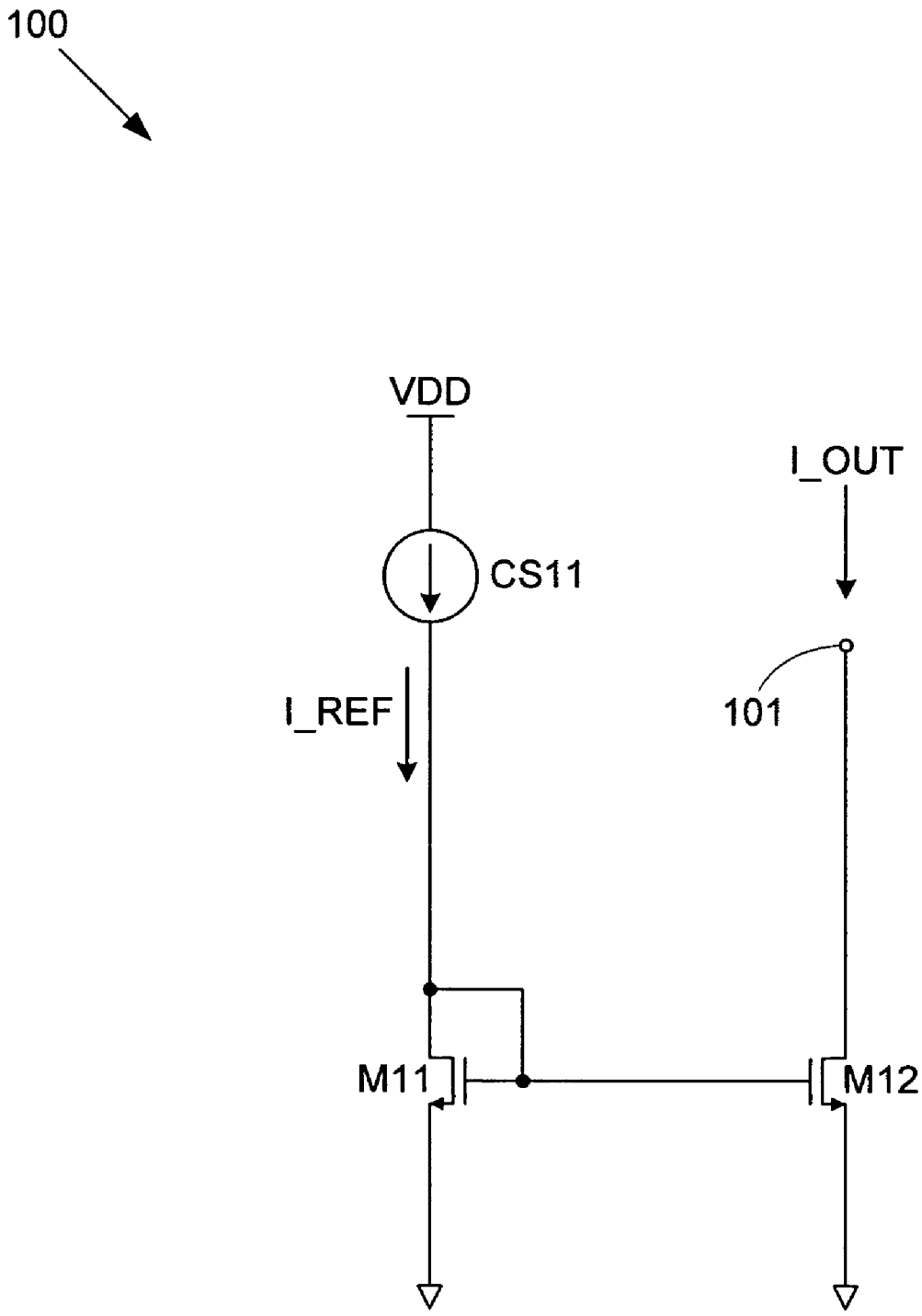
FIG. 1 (PRIOR ART)
FIG. 1 is a circuit diagram of a conventional current mirror.
Figure 2:
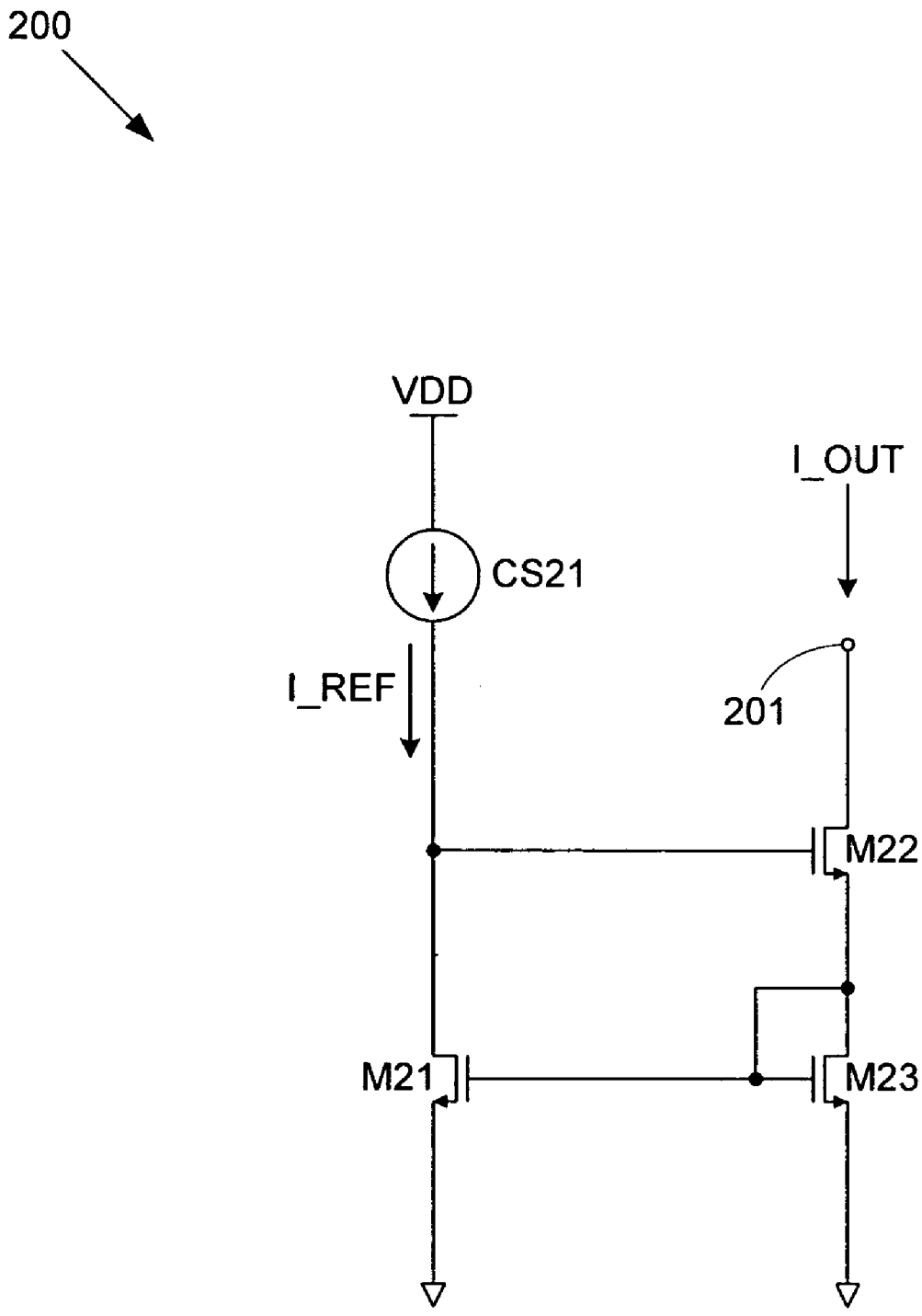
FIG. 2 (PRIOR ART)
FIG. 2 is a circuit diagram of a conventional Wilson current mirror.

Meanwhile, because current mirror 400 includes cascoded output transistors N43 and N44, and because transistor N43 is gate-coupled to the source of transistor P41, the output impedance Rout(400) of current mirror 400 is substantially similar to that of Wilson current mirror 200 shown in FIG. 2. Output impedance Rout(400) can therefore be given by:

$$Rout(\mathbf{400}) \approx Ro(\mathbf{43})(2+gm(\mathbf{41})Ro(\mathbf{41})) \tag{10}$$

where Ro(43) is the output impedance of transistor N43, gm(41) is the transconductance of transistor P41, and Ro(41) is the output impedance of transistor P41. In this manner, current mirror 400 provides a high output impedance.

Furthermore, by properly sizing transistor P41, the output voltage swing of current mirror 400 can be maximized. According to an embodiment of the invention, transistor P41 is sized such that it is in saturation at a gate-source voltage Vgs(41) equal to the sum of saturation voltage Vdsat and threshold voltage Vt, as indicated below:

$$Vgs(\mathbf{41}) = Vdsat + Vt \tag{11}$$

Consequently, while transistor P41 is in saturation, the voltage drop across transistor P41 (i.e., its drain-source voltage Vds(41)) is equal to saturation voltage Vdsat.

Therefore, the voltage Vs(41) at the source of transistor P41 is equal to saturation Vdsat plus the drain-source voltage Vds(42) of transistor N42. Based on Equation 1, the gate-source voltage of diode-connected transistor N42 is equal to the sum saturation voltage Vdsat and threshold voltage Vt, as indicated below:

$$Vgs(\mathbf{42}) = Vdsat + Vt \tag{12}$$

Thus, since the gate-source and drain-source voltages of transistor N42 are the same, the voltage Vs(41) at the source of transistor P41 is given by:

$$Vs(\mathbf{41}) = 2Vdsat + Vt \tag{13}$$

This voltage is then provided to the gate of transistor N43. Meanwhile, the voltage at the gate of transistor N42 (i.e., gate-source voltage Vgs(42)) is provided to the gate of transistor N44. The minimum output voltage of current mirror 400 is therefore equal to the sum of the minimum drain-source voltages of transistors N43 and N44 that keep those two transistors in saturation.

For transistors N43 and N44 to remain in saturation, their drain-source voltages must be at least equal to their gate-source voltages minus threshold voltage Vt (as indicated by Equation 1). For example, since transistor N44 receives a gate-source voltage equal to the sum of saturation voltage Vdsat and threshold voltage Vt, the minimum drain-source voltage required for transistor N44 to remain in saturation is simply equal to saturation voltage Vdsat.

Similarly, for transistor N43 to remain in saturation, its drain-source voltage Vds(43) must be at least equal to its gate voltage minus threshold voltage Vt. The voltage provided at the gate of transistor N43 is equal to twice saturation voltage Vdsat plus threshold voltage Vt (as indicated by Equation 13), while the voltage at the source of transistor N43 is equal to saturation voltage Vdsat (since the minimum drain-source voltage of transistor N44 is equal to saturation voltage Vdsat). Therefore, the gate-source voltage Vgs(43) of transistor N43 is given by:

$$Vgs(43)=(2Vdsat+Vt)-Vdsat \quad (14)$$

which resolves to:

$$Vgs(43)=Vdsat+Vt \quad (15)$$

Therefore, the minimum drain-source voltage Vds(43) of transistor N43 is simply equal to saturation voltage Vdsat (once again using Equation 1). As a result, the minimum output voltage Vout(min) of current mirror 400 is equal to twice saturation voltage Vdsat, as indicated by the following:

$$Vout(\min)=2Vdsat \quad (16)$$

Figure 3:
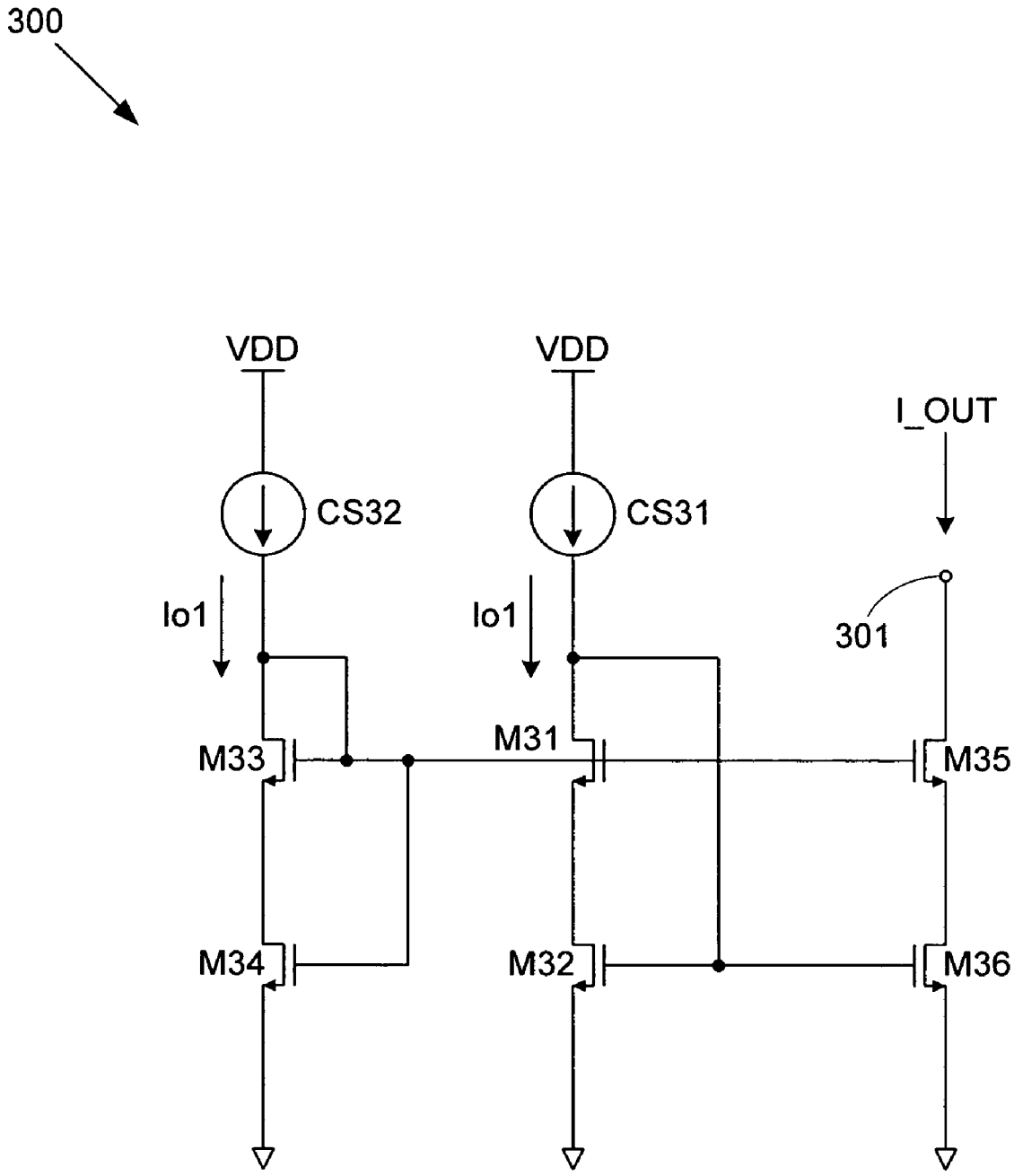
FIG. 3 (PRIOR ART)
FIG. 3 is a circuit diagram of conventional cascode current mirror.

In this manner, current mirror 400 combines a wide output voltage swing with a high output impedance in a simple (four-transistor) design. The output voltage of current mirror 400 can swing from upper supply voltage VDD all the way down to twice saturation voltage Vdsat. Current mirror 400 therefore provides a much higher output voltage range than Wilson current mirror 200 shown in FIG. 2, while providing the same high output impedance. Likewise, current mirror 400 provides as wide an output voltage range and as high an output impedance as cascode current mirror 300 shown in FIG. 3, but in a much more compact and power-efficient circuit.

Figure 5:
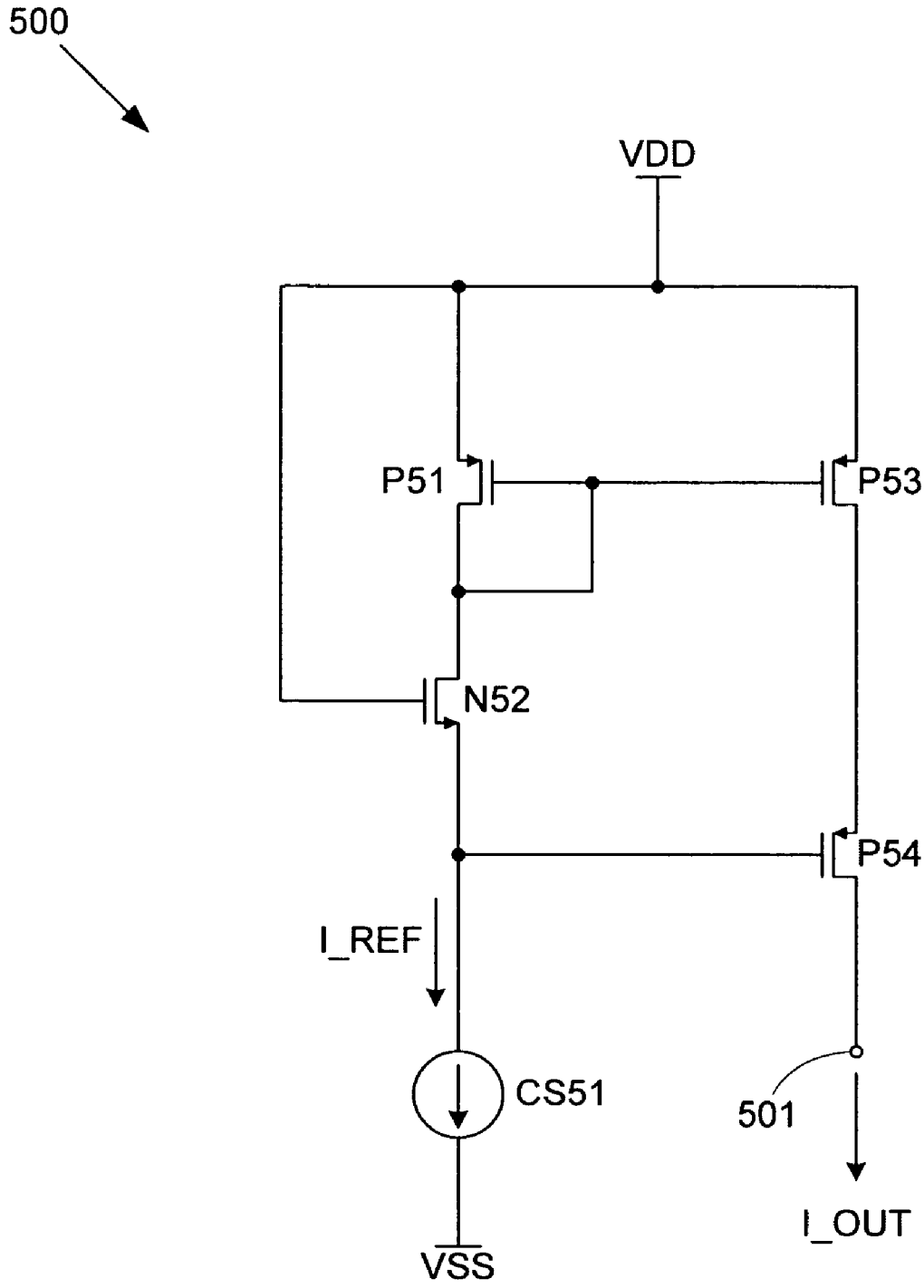
FIG. 5 is a circuit diagram of a high-swing current mirror with high output impedance, according to another embodiment of the invention.

FIG. 5 shows a current mirror 500 in accordance with another embodiment of the invention. Current mirror 500 includes a current source CS51, an output terminal 501, an NMOS (n-type metal-oxide-semiconductor) transistor N52, and PMOS (p-type metal-oxide-semiconductor) transistors P51, P53, and P54.

Note that, for exemplary purposes, transistors P51, N52, P53, and P54 are once again all described as being matched transistors having the same saturation voltages Vdsat and threshold voltages Vt. As noted above, this transistor matching allows current mirror 500 to provide a unity gain. However, according to various other embodiments of the invention, the transistors can be sized differently to produce differing electrical characteristics so that any desired gain can be provided by current mirror 500.

Transistor P51, transistor N52, and current source CS51 are connected in series between an upper supply voltage VDD and a lower supply voltage VSS (e.g., ground), while transistors P43 and P44 are connected in series between upper supply voltage VDD and output terminal 501. Current source CS51 supplies (sinks) a reference current I_REF that must be sourced by transistors P51 and N52.

Because the gate of transistor P53 is connected to the gate of transistor P51, transistor P53 receives the same gate voltage generated by diode-connected transistor P51. Therefore, as long as the drain-source voltage across transistor P53 is large enough to keep transistor P53 in saturation, transistor P53 will mirror reference current I_REF as output current I_OUT (since transistors P51 and P53 are matched).

Meanwhile, because current mirror 500 includes cascoded output transistors P53 and P54, and since transistor P54 is gate-coupled to the source of transistor N52 the output impedance Rout(500) of current mirror 500 is substantially similar to that of current mirror 200 shown in FIG. 2. Output impedance Rout(500) can therefore be given by:

$$Rout(500)\approx Ro(54)(2+_gm(52)Ro(52)) \quad (17)$$

where Ro(54) is the output impedance of transistor P54, gm(52) is the transconductance of transistor N52, and Ro(52) is the output impedance of transistor N52. In this manner, current mirror 500 provides a high output impedance.

Furthermore, by properly sizing transistor N52, the output voltage swing of current mirror 500 can be maximized. According to an embodiment of the invention, transistor P52 is sized such that it is in saturation at a gate-source voltage Vgs(52) equal to the sum of saturation voltage Vdsat and threshold voltage Vt, as indicated below:

$$Vgs(52)=Vdsat+Vt \quad (18)$$

Consequently, while transistor P52 is in saturation, the drain-source voltage Vds(52) across transistor P52 is equal to saturation voltage Vdsat.

Therefore, the voltage Vs(52) at the source of transistor N52 is equal to upper supply voltage VDD minus saturation voltage Vdsat minus the drain-source voltage Vds(51) of transistor P51. Based on Equation 1, the gate-source voltage Vgs(51) of diode-connected transistor P51 is equal to the sum of saturation voltage Vdsat and threshold voltage Vt, as indicated below:

$$Vgs(51)=Vdsat+Vt \quad (19)$$

Thus, since the gate-source and drain-source voltages of diode-connected transistor P51 are the same, the voltage at the source of transistor P52 is given by:

$$Vs(52)=VDD-2Vdsat-Vt \quad (20)$$

This voltage is also provided to the gate of transistor P54. Meanwhile, the voltage at the gate of transistor P51 is provided to the gate of transistor P53. Note that because both transistors P51 and P53 are source-coupled to upper supply voltage VDD, the gate-source voltages of the two transistors are the same (i.e., Vgs(51)=Vgs(53)). The maximum output voltage of current mirror 500 is equal to upper supply voltage VDD minus the sum of the minimum drain-source voltages of transistors P53 and P54 that keep those two transistors in saturation.

For transistors P53 and P54 to remain in saturation, their drain-source voltages must be at least equal to their gate-source voltages minus threshold voltage Vt (as indicated by. Equation 1). For example, since transistor P53 receives a gate-source voltage equal to the sum of saturation voltage Vdsat and threshold voltage Vt, the minimum drain-source voltage required for transistor N53 to remain in saturation is simply equal to saturation voltage Vdsat.

Similarly, for transistor P54 to remain in saturation, its drain-source voltage Vds(54) must be at least equal to its gate voltage minus threshold voltage Vt. The voltage provided at the gate of transistor P54 is equal to upper supply voltage VDD minus twice saturation voltage Vdsat minus threshold voltage Vt (as indicated by Equation 20), while the voltage at the source of transistor P54 is equal to supply voltage VDD minus saturation voltage Vdsat (since the minimum drain-source voltage of transistor N53 is equal to saturation voltage Vdsat). Therefore, the gate-source voltage Vgs(54) of transistor P54 is given by:

$$Vgs(\mathbf{54})=(VDD-Vdsat)-(VDD-2Vdsat-Vt) \quad (21)$$

which resolves to:

$$Vgs(\mathbf{54})=Vdsat+Vt \quad (22)$$

Therefore, the minimum drain-source voltage Vds(54) of transistor P54 is simply equal to saturation voltage Vdsat (once again using Equation 1). As a result, the maximum output voltage Vout(min) of current mirror 500 is equal to upper supply voltage VDD minus twice saturation voltage Vdsat, as indicated by the following:

$$Vout(\max)=VDD-2Vdsat \quad (23)$$

In this manner, current mirror 500 combines a wide output voltage swing with a high output impedance in a simple (four-transistor) design. The output voltage for current mirror 500 can swing from lower supply voltage VSS all the way to two times saturation voltage Vdsat of upper supply voltage VDD—i.e., from lower supply voltage VSS to upper supply voltage VDD minus 2Vdsat. Therefore, like current mirror 400 shown in FIG. 4, current mirror 500 provides the same high output impedance and a much higher output voltage range than Wilson current mirror 200 shown in FIG. 2, and also provides the same high output impedance and wide output voltage range of cascode current mirror 300 shown in FIG. 3 in a much more compact and power-efficient circuit.

The various embodiments of the structures and methods of this invention that are described above are illustrative only of the principles of this invention and are not intended to limit the scope of the invention to the particular embodiments described. Thus, the invention is limited only by the following claims and their equivalents.

What is claimed is:

1. A current mirror comprising:

a first transistor of a first conductivity type, the first transistor being diode-connected;

a second transistor of a second conductivity type, a drain of the second transistor being connected to a drain of the first transistor, and a gate of the second transistor being connected to a source of the first transistor;

a third transistor of the first conductivity type, a gate of the third transistor being connected to a gate of the first transistor; and a fourth transistor of the first conductivity type, a gate of the fourth transistor being connected to a source of the second transistor.

2. The current mirror of claim 1, further comprising a current source connected to the source of the second transistor.

3. The current mirror of claim 1, wherein the first transistor, the second transistor, the third transistor, and the fourth transistor are matched transistors.

4. The current mirror of claim 1, wherein the first transistor, the third transistor, and the fourth transistor comprise n-type metal-oxide-semiconductor (NMOS) transistors, and wherein the second transistor comprises a p-type metal-oxide-semiconductor (PMOS) transistor.

5. The current mirror of claim 4, wherein the current source, the second transistor, and the first transistor are connected in series between a first supply voltage and a second supply voltage, and wherein the fourth transistor and the third transistor are connected in series between an output terminal and the second supply voltage.

6. The current mirror of claim 1, wherein the first transistor, the third transistor, and the fourth transistor comprise p-type metal-oxide-semiconductor (PMOS) transistors, and wherein the second transistor comprises an n-type metal-oxide-semiconductor (NMOS) transistor.

7. The current mirror of claim 6, wherein the first transistor, the second transistor, and the current source are connected in series between a first supply voltage and a second supply voltage, and wherein the third transistor and the fourth transistor are connected in series between the first supply voltage and an output terminal.

8. A method for generating an output current, the method comprising:

providing a reference current to a diode-connected transistor via a saturated transistor, wherein the diode-connected transistor and the saturated transistor have different conductivity types;

providing a gate voltage of the diode-connected transistor to a mirroring transistor to generate an output current;

providing the output current to an output terminal via an output transistor; and providing a source voltage of the saturated transistor to a gate of the output transistor.

9. The method of claim 8, wherein the diode-connected transistor, the saturated transistor, the mirroring transistor, and the output transistor are all matched transistors.

10. The method of claim 8, wherein the diode-connected transistor, the mirroring transistor, and the output transistor comprise n-type metal-oxide-semiconductor (NMOS) transistors, and wherein the saturated transistor comprises a p-type metal-oxide-semiconductor (PMOS) transistor.

11. The method of claim 10, wherein providing the reference current to the diode-connected transistor via the saturated transistor comprises:

providing a current source, the saturated transistor, and the diode-connected transistor in series between a first supply voltage and a second supply voltage; and providing the second supply voltage to a gate of the saturated transistor.

12. The method of claim 8, wherein the diode-connected transistor, the mirroring transistor, and the output transistor comprise p-type metal-oxide-semiconductor (PMOS) transistors, and wherein the saturated transistor comprises an n-type metal-oxide-semiconductor (NMOS) transistor.

13. The method of claim 12, wherein providing the reference current to the diode-connected transistor via the saturated transistor comprises:

providing the diode-connected transistor, the saturated transistor, and a current source in series between a first supply voltage and a second supply voltage; and providing the first supply voltage to a gate of the saturated transistor.

14. A method for providing an output current, the method comprising:

cascoding a first transistor and a second transistor between an output terminal and a first supply voltage;

supplying a reference current to a third transistor via a fourth transistor, the third transistor being diode-connected, the third transistor and the fourth transistor having different conductivity types;

providing the first supply voltage to a gate of the fourth transistor;

providing a gate voltage of the third transistor to a gate of the second transistor; and providing a source voltage of the fourth transistor to a gate of the first transistor.

15. The method of claim 14, wherein the first transistor, the second transistor, the third transistor, and the fourth transistor comprise matched transistors.

16. The method of claim 14, wherein the second transistor, the third transistor, and the fourth transistor comprise n-type metal-oxide-semiconductor (NMOS) transistors, and wherein the first transistor comprises a p-type metal-oxide-semiconductor (PMOS) transistor.

17. The method of claim 14, wherein the second transistor, the third transistor, and the fourth transistor comprise P-type metal-oxide-semiconductor (PMOS) transistors, and wherein the first transistor comprises an n-type metal-oxide-semiconductor (NMOS) transistor.

* * * * *